United States Patent [19]

Amirijafari et al.

[11] Patent Number: 4,495,057

[45] Date of Patent: Jan. 22, 1985

[54] COMBINATION THERMAL AND SOLVENT EXTRACTION OIL RECOVERY PROCESS AND APPARATUS

[76] Inventors: Bahram Amirijafari, 2051 Crestvue Cir., Golden, Colo. 80401; Herbert E. Nuttall, Jr., 1445 Honeysuckle Dr., NE., Albuquerque, N. Mex. 87127

[21] Appl. No.: 376,251

[22] Filed: May 7, 1982

[51] Int. Cl.[3] ..... C10G 1/02; C10G 1/04; C10G 1/00; C10B 53/06

[52] U.S. Cl. ..... 208/11 R; 208/11 LE

[58] Field of Search ..... 208/11 R, 11 LE; 202/107, 84

[56] References Cited

U.S. PATENT DOCUMENTS

| | | | |
|---|---|---|---|
| Re. 16,127 | 7/1925 | Day . | |
| 3,619,406 | 11/1971 | Bowman et al. | 208/11 LE |
| 4,046,668 | 9/1977 | Farcasiv et al. | 208/11 LE |
| 4,054,505 | 10/1977 | Hart et al. . | |
| 4,054,506 | 10/1977 | Hart et al. . | |
| 4,071,433 | 1/1978 | Hanson . | |
| 4,071,434 | 1/1978 | Gifford | 208/11 LE |
| 4,098,674 | 7/1978 | Rammler et al. | 208/11 LE X |
| 4,130,474 | 12/1978 | Anthony | 208/11 LE |
| 4,180,455 | 12/1979 | Taciuk . | |
| 4,197,183 | 4/1980 | Audeh . | |
| 4,240,897 | 12/1981 | Clarke | 208/11 LE |
| 4,276,021 | 6/1981 | Karnofsky et al. | 208/11 LE X |
| 4,337,143 | 6/1982 | Hanson et al. | 208/11 LE X |

*Primary Examiner*—Delbert E. Gantz
*Assistant Examiner*—Glenn A. Caldarola
*Attorney, Agent, or Firm*—Fields, Lewis, Pittenger & Rost

[57] ABSTRACT

A combination process disclosed utilizes a thermal (pyrolysis) operation (12) and solvent extraction operation (11) that operate simultaneously on an infeed of crushed tar sand (13). In a heat recovery operation (15) the solvent extraction operation receives waste heat from hot spent sand from the thermal operation to increase operating efficiency of the process. Makeup solvent is taken from the oil product derived from the extraction operation and recycled to be used in the solvent extraction operation. In a blending operation (16) the sand from both thermal and solvent extraction operations are blended in a sand mixer (34) to improve the quality of the sand discharged and the oil products from both operations are blended by a product mixer (31) to increase the viscosity of the final oil product.

14 Claims, 6 Drawing Figures

COMBINATION THERMAL AND SOLVENT EXTRACTION OIL RECOVERY PROCESS AND APPARATUS

TECHNICAL FIELD

This invention relates to a novel and improved process and apparatus for recovering synthetic crude from tar sands.

BACKGROUND ART

Known deposits of tar sands in the United States are large enough to have a major impact on the supply of crude oil. An important consideration with regard to the processing of these tar sands is that most of the deposits of tar sand in the United States are scattered and are not close to the refineries. This fact produces a need for a tar sand refining process and apparatus that can be built as a small module to economically produce on the order of 1,000 to 2,000 barrels per day from these smaller deposits.

Various types of thermal (pyrolysis) processes and solvent extraction processes have heretofore been used to extract synthetic crude from tar sands. Some of the thermal processes presently known involve the use of a variety of horizontal or vertical retort vessels or kilns for the retort. In particular the Lurgi-Rhurgas process uses a mixing screw-type retort and the Tacuik process uses a rotary kiln-type retort. Some of the solvent extraction processes presently known are the Western Tar Sand processes described in the U.S. Pat. Nos. 4,054,505 and 4,054,506 which includes the use of ultrasonic energy, the CAG (Charles-Adams-Garbett) process using a water-base extraction, and the Randall process using hot water. Past practices have generally involved the use of either a thermal process or a solvent extraction process.

Generally, in known solvent extraction processes the tar sand is subjected to a solution in which the bitumen is soluble and in the presence of this solution substantially all of the bitumen is dissolved and the result is a high recovery of the bitumen and a substantially bitumen-free sand product. The advantages in the solvent extraction is the high recovery, a generally lower capital cost, and relative ease in scaling up to larger sizes. The disadvantages of the solvent extraction processes is the expense of solvents, the necessity of shipping solvents to the plant, heat requirements. Further the heavy oil product derived is not suitable for transportation, and difficulty is involved in recovering the solvent from the sand so the sand can be returned to the environment.

The advantages of known thermal processes is that they do not require large amounts of energy, the sand derived is clean and dry, the oil product is transportable and the operating costs are generally low. The disadvantages of known thermal processes are that there is less recovery from the bitumen, the capital costs are higher, the scale-up problems are considerable and there is the problem of handling the waste heat generated.

In U.S. Pat. No. 4,197,183 there is disclosed a combination thermal and solvent extraction process wherein the oil product from the thermal process is fed to the solvent extraction process so that the tar sand undergoes a successive or series heating and then a solvent extraction operation. Heat from the thermal process is disclosed as being used to heat the solvent to maintain the temperature of the solvent extraction operation.

DISCLOSURE OF INVENTION

Separate, simultaneously operating, thermal and solvent extraction operations are arranged in parallel and each receives a stream of tar sand crushed to a different fineness. Heat from spent sand taken from the thermal operation is used to raise the temperature of the substantially bitumen-free sand and the relatively heavy oil-solvent mixture produced in the solvent extraction operation and to recover solvent from the sand and oil products taken from the extraction operation to increase overall energy efficiency of the operation. A product mixer blends the lighter oil product from the thermal operation with the heavier oil product from the solvent extraction operation to provide a lighter final oil product thereby eliminating the necessity of adding diluents otherwise necessary to render the oil product transportable. A sand mixer blends the bitumen-free sand and the spent sand from both operations which is more acceptable for discharge into the environment. The oil product from the thermal operation is suitable to provide a make-up solvent for the solvent extraction operations. A solvent is derived from the extraction operation which is recycled in a closed, solvent-circulating system back to the solvent extraction unit. All solvent in the solvent extraction operation is recirculated.

BRIEF DESCRIPTION OF DRAWINGS

The details of this invention will be described in connection with the accompanying drawings, in which.

DETAILED DESCRIPTION

Figure 1:
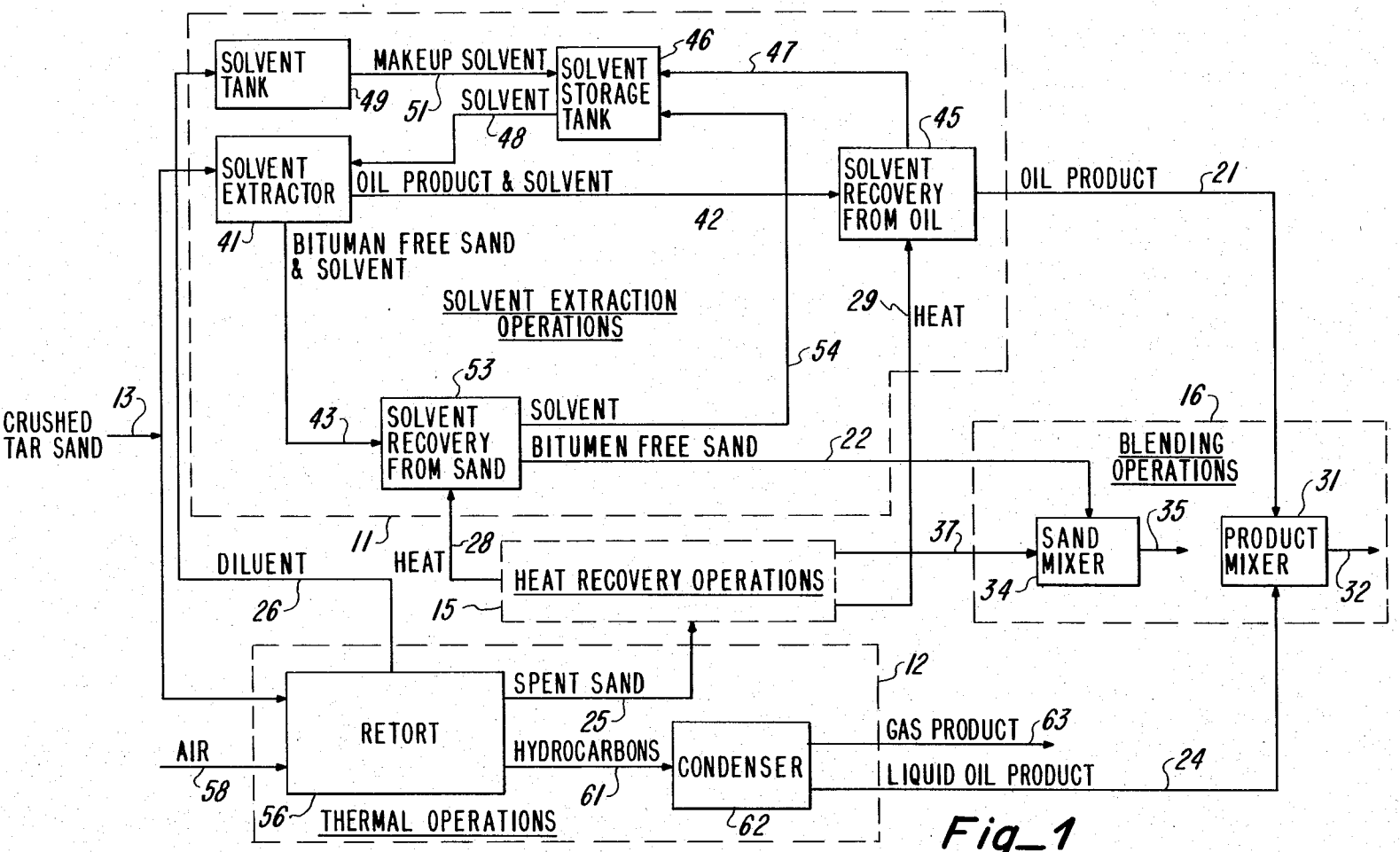
FIG. 1 is a schematic diagram illustrating required operations and some of the specific apparatus according to the present invention.

Referring now to FIG. 1, the operation will first be described generally with reference to three operations indicated by dashed line blocks 11, 12 and 15. A solvent extraction operation 11 and a thermal operation 12 are arranged parallel to one another and both receive a stream of crushed tar sand indicated as being fed through line 13. Operations 11 and 12 are carried out simultaneously and independently of one another. The thermal operation 13 is interposed between operations 11 and 12 and generally stated recovers and transfers heat from operation 11 to operation 12.

The solvent extraction operation 11 produces a high viscosity or heavy oil product that is withdrawn through line 21 and a substantially bitumen-free sand that is withdrawn through line 22. The thermal operation 12 produces a low viscosity or lighter oil product that is withdrawn through line 24 and a hot spent sand is withdrawn via line 25. The high viscosity oil product taken from the solvent extraction operation generally includes the heavier hydrocarbon fractions which have gravity of about 10° to 15° API. The low viscosity oil product taken from the thermal operation generally leaves different fractions of hydrocarbons which have a gravity of about 15° to 20° API. The thermal operation 12 produces a distilled low viscosity oil product that is recycled as a diluent through line 26 to the solvent tank in the solvent extration operation. Heat recovered from thermal operation 12 is transferred to the solvent extraction operation through lines 28 and 29.

A blending operation 16 shown in FIG. 1 including a product mixer 31 blends the higher viscosity oil product with the lower viscosity oil product to provide a composite upgraded synthetic crude product, indicated as passing through line 32. This final oil product is of less viscosity than the oil product from the solvent extraction operation having a gravity of about 15° API and considered in the industry to be a transportable, upgraded oil product. A sand mixer 34 blends the substantially bitumen-free sand with the spent sand to provide a mine disposable solid waste product, which is indicated as passing through line 35.

The solvent extraction operation 11 is further illustrated to include a solvent extractor 41 which receives crushed tar sand through line 13 and has a stream of oil product and solvent withdrawn through line 42, together with a stream of substantially bitumen-free sand and solvent withdrawn through line 43.

A solvent recovery from oil unit 45 separates solvent from the oil product, the solvent being passed to a solvent storage tank 46 through line 47. From the solvent storage tank 46 solvent is returned to the solvent extractor 41 through line 48. The solvent supply tank 49 delivers makeup solvent through line 51 to tank 46. The oil product is passed from the solvent recovery unit 45 to the product mixer 31 through line 21.

A solvent recovery from sand unit 53 separates solvent from the substantially bitumen-free sand, the solvent being passed through line 54 to the solvent storage tank 46. Bitumen-free sand is passed from solvent recovery unit 53 through line 22 to the sand mixer 34. Organic solvents suitable for operation 11 include hexane, kerosene and toluene.

In the above described operations it is understood that different solvents, organic or inorganic solvents, or two or more solvents may be used. The solvent extractor 41 can be aided by mechanical mixers, vibrators or ultrasonic units.

Solvent recovery from the sand may be accomplished by direct heating, indirect heating, the use of hot water for washing, drying with hot inert gas, or the use of steam, oil, or other fluids in indirect heating.

Solvent recovery from the oil product may be accomplished by using distillation, pressurizing, flashing, or other known techniques. One or more oil products may be obtained, depending on the upgrading in the solvent recovery unit.

The thermal operation 12 shown in FIG. 1 has a retort 56 which receives crushed tar sand through line 13 and air from a suitable air supply through air line 58. Hot spent sand is delivered from the retort 56 through line 25 to thermal operation 15 and a cooled spent sand is delivered from operation 15 to the blending operation 11 and in particular the sand mixer 34. The waste heat from the hot sand is used in the solvent extraction operation. In particular, heat is transferred from the hot spent sand through line 28 to the solvent recovery from sand unit 53 and from the hot spent sand to the solvent recovery from oil unit 45 via line 29. The oil product (hydrocarbons) from the retort 56 is passed through a condenser 62 which separates the hydrocarbons into a gaseous product, indicated as passing through line 63, and a liquid oil product that is passed through line 24 to the blending operations 16 and in particular product mixer 31.

Retort 56 can be horizontal or vertical vessels and also a rotary kiln. A Lurgi-Rhurgas operation shown in FIG. 5 can be used in place of retort 56. Moreover, it is understood that pure oxygen instead of atmospheric air, or a mixture of the two, can be used as an input through air line 58.

Figure 2:
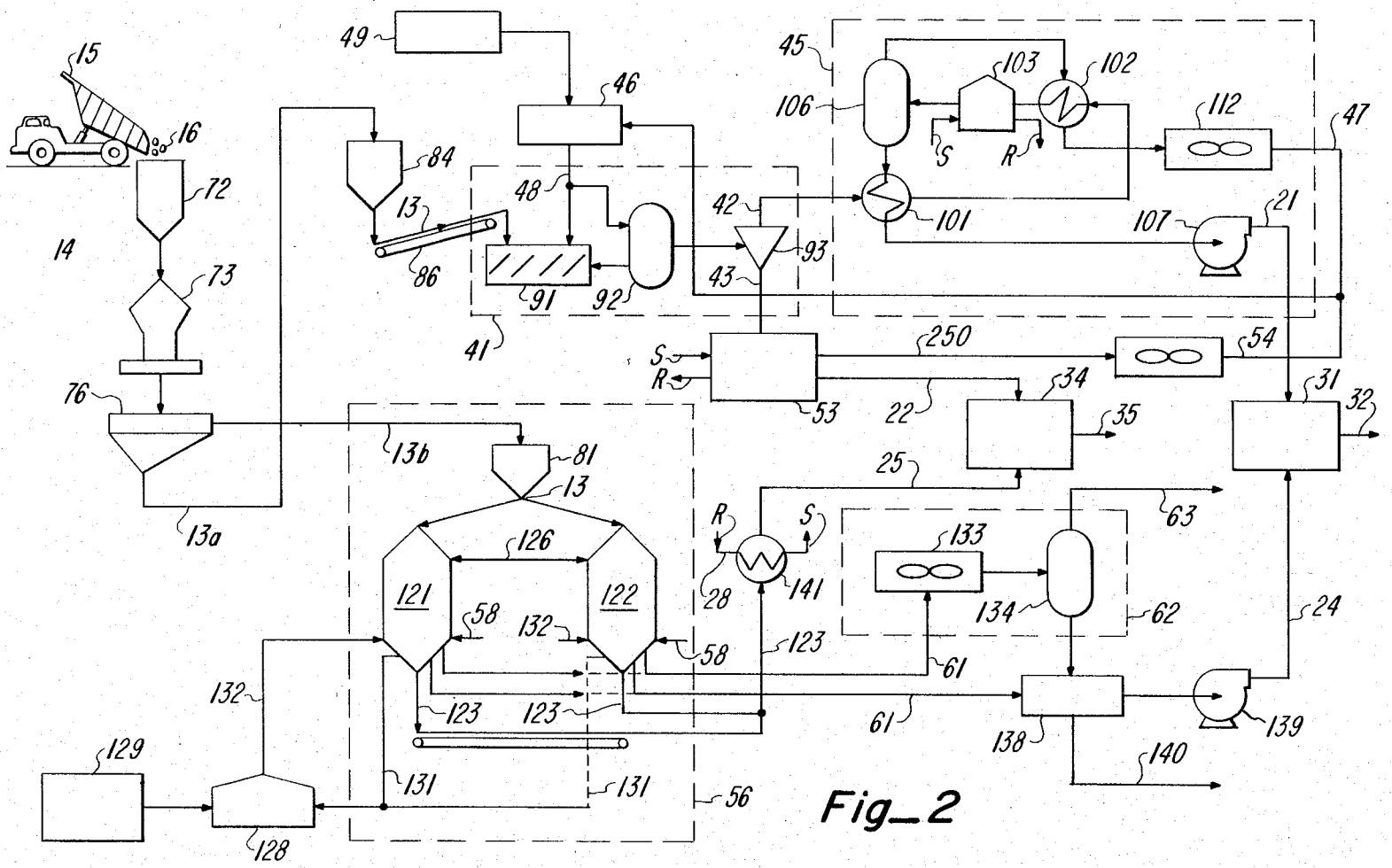
FIG. 2 is a schematic diagram illustrating still further details of operations and a more specific example of apparatus according to the present invention.

Referring now to FIG. 2, a tar sand supply represented as a truck 15 empties tar sand 16 into a storage hopper 72. Hopper 72 feeds a crusher 73 and crushed tar sand is delivered to a screen 76. A feed stream of coarse or large tar sand particles is deivered to a storage hopper 81 for retort 56 through line **13*a*. A feed of fines or smaller tar sand particles is delivered to a storage hopper 84 through line 13*b*, which in turn feeds a conveyor 86. The conveyor 86 delivers a stream of crushed tar sand as a feed stream 13 into the solvent extractor 41**.

In FIG. 2 the solvent extractor 41 is shown to include an ultrasonic unit 91 receiving tar sand through line 13. Briefly in the ultrasonic unit 91 bitumen is removed from the tar sand by submerging the tar sand in a solvent and sonicating the solvent with sonic energy to break apart bonds so that the bitumen can go into solution in a mixture. Unit 91 delivers a mixture to a three-stage solvent extraction system represented by vessel 92 and a cyclone separator 93. The three-stage solvent system is described in more detail hereinafter with reference to FIG. 3.

Bitumen-free sand and solvent are passed as an underflow of separator 93 into a solvent recovery unit 53 through sand and solvent line 43. The oil product and solvent are passed from the overflow of separator 93 through an oil product and solvent line 42 to solvent recovery unit 45.

Figure 3:
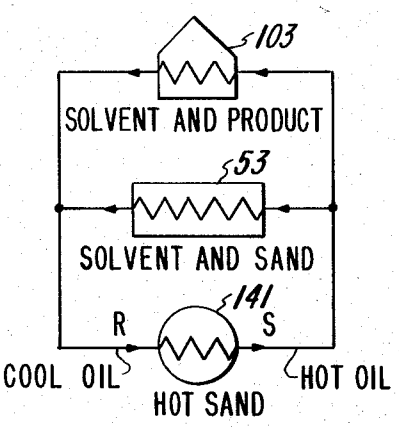
FIG. 3 is a schematic diagram illustrating further details of the three-stage solvent extraction system and the ultrasonic-mixing apparatus shown in FIG. 2.

The solvent recovery unit 45 shown in FIG. 3 is a flash recovery system which includes, in series, heat exchanger 101, heat exchanger 102, and heater (furnace) 103. The oil product and solvent in line 42 are successively passed through exchangers 101, 102 and heater 103, which raises their temperature. The heated oil product and solvent from heater 103 are then passed through a flasher 106.

In flasher 106 the oil product is separated from the solvent and the oil product passes through the bottom of the flasher after it gives up heat in heat exchanger 101. The oil product from the bottom of flasher 106 is pumped by pump 107 through line 21 to product mixer 31. The solvent, which is in a vapor state, is passed from the top of flasher 106 through heat exchanger 102, which reduces its temperature, and the cooled solvent is then passed through a cooler 112, the recovered solvent being taken from cooler 112 and delivered through line 47 to tank 46. The major increase in the temperature of the product-solvent mixture is produced by heater 103. The heat to heater 103 is provided heat exchanger 141 described hereinafter.

Retort 56 shown in FIG. 2 includes two retort vessels 121 and 122, each of which receives a stream of crushed tar sand from storage hopper 81 through line 13. Retort vessels 121 and 122 are alternately operable, one burning while the other is being filled. One section of one retort vessel is emptied from the bottom and a fill section is filled from the top. One retort vessel burns while the other is being filled. Accordingly, the input and output lines from each of the retort vessels 121 and 122 bear the same numerals.

Retort vessel 121 is shown to have an air input line 58 for introducing air to support combustion therein and an output line 123 in the bottom through which hot spent sand is passed by a conveyor 124. Output lines 123 connected via heat exchanger 141 to spent sand line 25 above described.

Retort gas is passed between the upper portions of the retort vessels 121 and 122 through line 126. A water collector 128 receives water from a water tank 129. Water is passed from the retort vessels 121 or 122 to the collector 128 through line 131 water is passed from the collectors 138 to the retort vessels 121 and 122 through line 132. The oil product from the vessels is shown as being passed through two lines 61. The product in one of the lines 61 is cooled in the condenser 62 shown as a cooler 133 and the cooled product is then passed into a separator drum 134 where it produces a gas product that is passed through line 63. The liquid oil product in the other line 61 from the retort vessels is passed through an oil-water separator 138. The liquid oil product taken from separator 138 is pumped by pump 139 through line 24 to the product mixer 31. The viscosity of the oil product taken from the thermal process through line 24 which has a gravity of about 15° to 20° API and therefore in the combination it is not necessary to bring in additional diluent for use in the solvent extraction process. The lighter product is distilled to provide the needed solvent make-up solvent tanks 46 and 49. The water taken from separator 138 is indicated as being passed through line 140 and may be used for the retorts 56, for utilities, or for disposal use on the spent sand.

The heat recovery operations shown with more particularity in FIGS. 2 and 3 include a heat exchanger 141 that receives heat from the hot spent sands from retort vessels 121 and 122 through line 123. The heat exchanger 141 has a hot oil source line designated S and a hot oil return line designated R. The specific connections between the two operations for FIG. 2 are shown in FIG. 3.

The solvent extraction operation has the heater 103 with a line designated S connected to the line designated S on exchanger 141 and a line designated R connected to the line designated R on exchanger 141. In this way the hot oil from exchanger 141 is passed into heater 103 which is a part of the solvent recovery from oil unit 45 so that waste heat from the thermal operation is in heat exchange relation to and serves to carry out the extraction of the solvent from the oil product in the solvent extraction operations.

In a like manner the solvent recovery from sand unit 45 has a line designated S connected to the line designated S on exchanger 141 and a line designated R connected to the line designated R on exchanger 141. Hot oil from exchanger 141 is passed into unit 53 in the heat exchanger with the solvent-sand from the extraction process via line 43 so that the waste heat carries out the extraction of the solvent from the sand.

A considerable economic advantage is attained and energy efficiency achieved by using the waste heat from the thermal to removal solvent from the extraction sand and oil product. The heat from the hot spent sand can provide all or at least a substantial part of the heat necessary for the solvent extraction operation. Moreover, by using heat from the thermal a combination of the two along with a mixing of the sand makes units suitable for smaller modules more feasible as well as upsized larger plants.

The following table shows a specific example for a specific quantity of tar sand as relates to the apparatus shown in FIG. 3.

EXAMPLE 1

| Refer To Numerals In FIG. 3 | 16 | 13a | 13b | 49 | 129 | 63 and 140 | 24 | 21 | 32 | 43 | 25 | 35 |
|---|---|---|---|---|---|---|---|---|---|---|---|---|
| Total (lbs) | 12,425 | 5,050 | 7,375 | 22 | 591 | 824 | 328 | 360 | 688 | 4,712 | 6,814 | 11,526 |
| Tar Sands: | | | | | | | | | | | | |
| Tar | 994 | 404 | 590 | — | — | — | 325 | 343 | 668 | 61 | 24 | 90 |
| Sand | 11,431 | 4,646 | 6,785 | — | — | — | — | — | — | 4,646 | 6,785 | 11,431 |
| Solvent (lbs) | — | — | — | 22 | — | — | — | 17 | 17 | 5 | — | 5 |
| Water (lbs) | — | — | — | — | 591 | 588 | 3 | — | 3 | — | — | — |
| Product Gas | — | — | — | — | — | 236 | — | — | — | — | — | — |
| Temp. °F. | Amb. | Amb. | Amb. | Amb. | Amb. | Amb. | 130 | 130 | 130 | 120 | 700 | 150 |
| Pressure psig. | Atm. | Atm. | Atm. | Atm. | Atm. | Atm. | 3 | 3 | 3 | Atm. | Atm. | Atm. |

The weight of the bitumen in the tar sand is 8% by weight. The recovery rate for the thermal process equals about 50–60% by weight conversion to liquid oil gas. The recovery rate for the solvent extraction process is assumed to be a minimum of about 80–90% by weight. The discharged sand from the solvent process is about 0.1% by weight residual solvent. The solvent fraction in the product oil from the solvent process is about 5% by volume.

Figure 4:
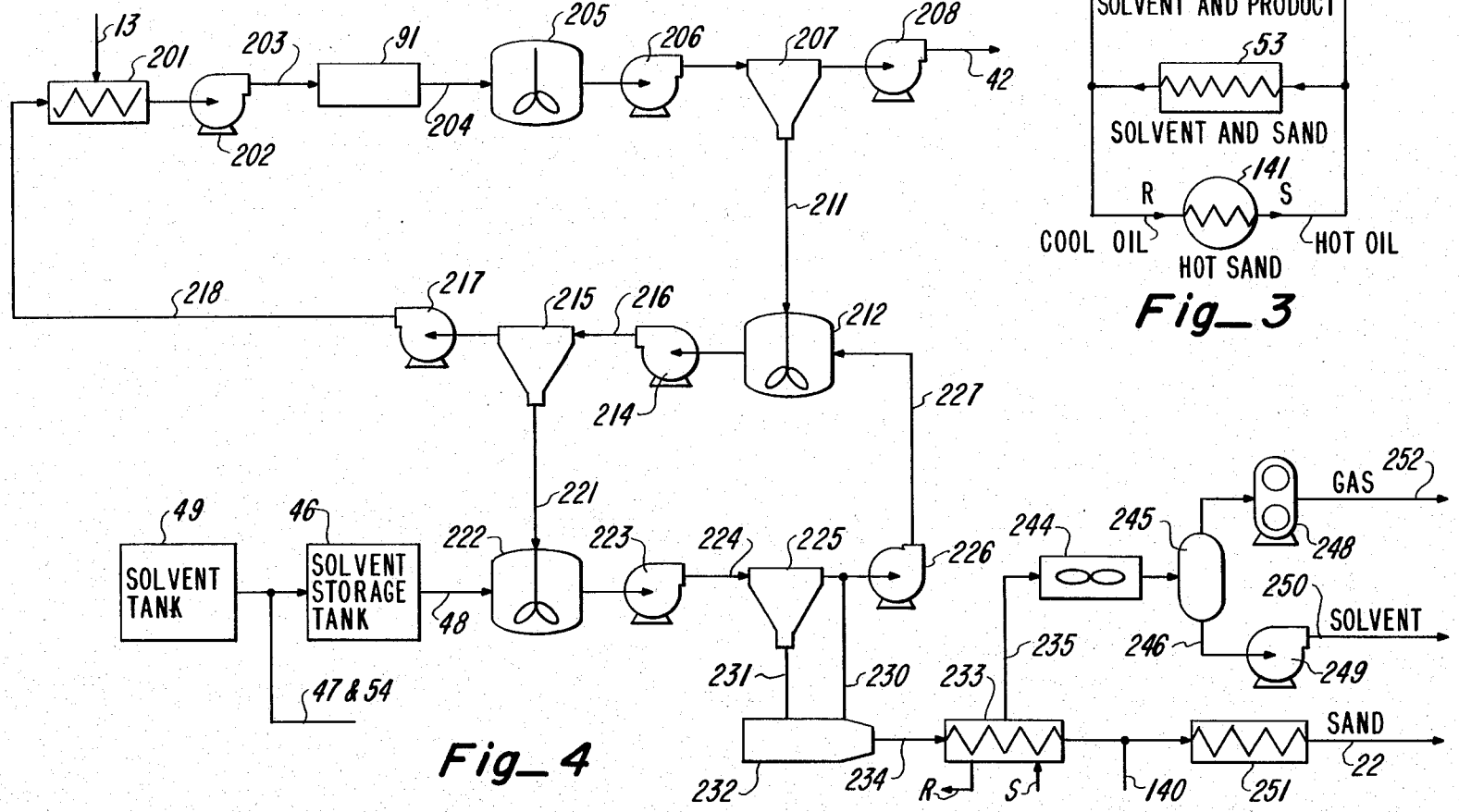
FIG. 4 is a schematic diagram showing the transfer of heat from the hot sand to the solvent operation.

The solvent extractor 41 shown in more detail in FIG. 4 has the tar sand feed through line 13 passed into a premixer 201 and from there it is pumped by pump 202 through line 203 into the ultrasonic unit 91. The details of the ultrasonic operation for this purpose are described in U.S. Pat. Nos. 4,054,505 and 4,054,506.

From the ultrasonic extraction unit 91 the feed is delivered through line 204 to a primary mixer 205 and pumped by pump 206 from the primary mixer into a primary cyclone, thickener train 207. The overflow of train 207, which is oil product and solvent, is pumped by pump 208 from train 207 through oil product and solvent line 42 above described.

Primary underflow from train 207 is delivered through line 211 into the top of a secondary mixer 212, from which it is pumped by pump 214 into a secondary cyclone, thickener train 215, the reclaimed liquor is pumped by pump 217 through line 218 back into premixer 201.

Secondary underflow from train 215 is passed through line 221 into the top of a tailings mixer 222. Mixer 222 receives fresh solvent from tank 49 and through return lines 4, 7 and 54. The output of mixer 222 is pumped by pump 223 through line 224 into a tailings cyclone, thickener train 225. The reclaimed liquor from train 225 is passed into secondary mixer 212 by pump 226 through line 227.

The tailings underflow from train 225 is passed into a centrifuge 232 through line 231. In the centrifuge 232 the tailings underflow is dried and the dried material is passed into a tailings drier 233 through line 234. A return line 230 passes material from the top of centrifuge 232 back into line 227 via pump 226.

Reclaimed vapor is taken from the top of drier 233 and passed through a cooler 241 through line 235. Heat is received by drier 233 from the thermal operation previously described, as indicated by lines S and R which connect to corresponding lines of exchange 141. The output of cooler 241 is passed into a separator drum 245.

Reclaimed solvent is taken from the bottom of the separator drum 245 through line 246 and a pump 249 is used to pump this solvent through a line indicated at 250. The solvent vapor taken from the top of the separator drum 245 is passed by a blower 248 into a vapor line 252 which preferably is connected to a vapor recovery system. The vapor recovery system serves to recover solvent vapors from sources such as storage tanks, mixers, etc. The output of tailings drier 233 is passed into a deduster 251 and the output of deduster 251 becomes the clean sand that passes through line 22 into the sand mixer 34.

The following table shows a specific example for a specific quantity of tar sand as related to the apparatus shown in FIG. 4:

EXAMPLE 2

It is understood that the present invention contemplates that any thermal process for treating tar sands that produce excess heat may be advantagiously combined with any solvent extraction process.

Figure 5:
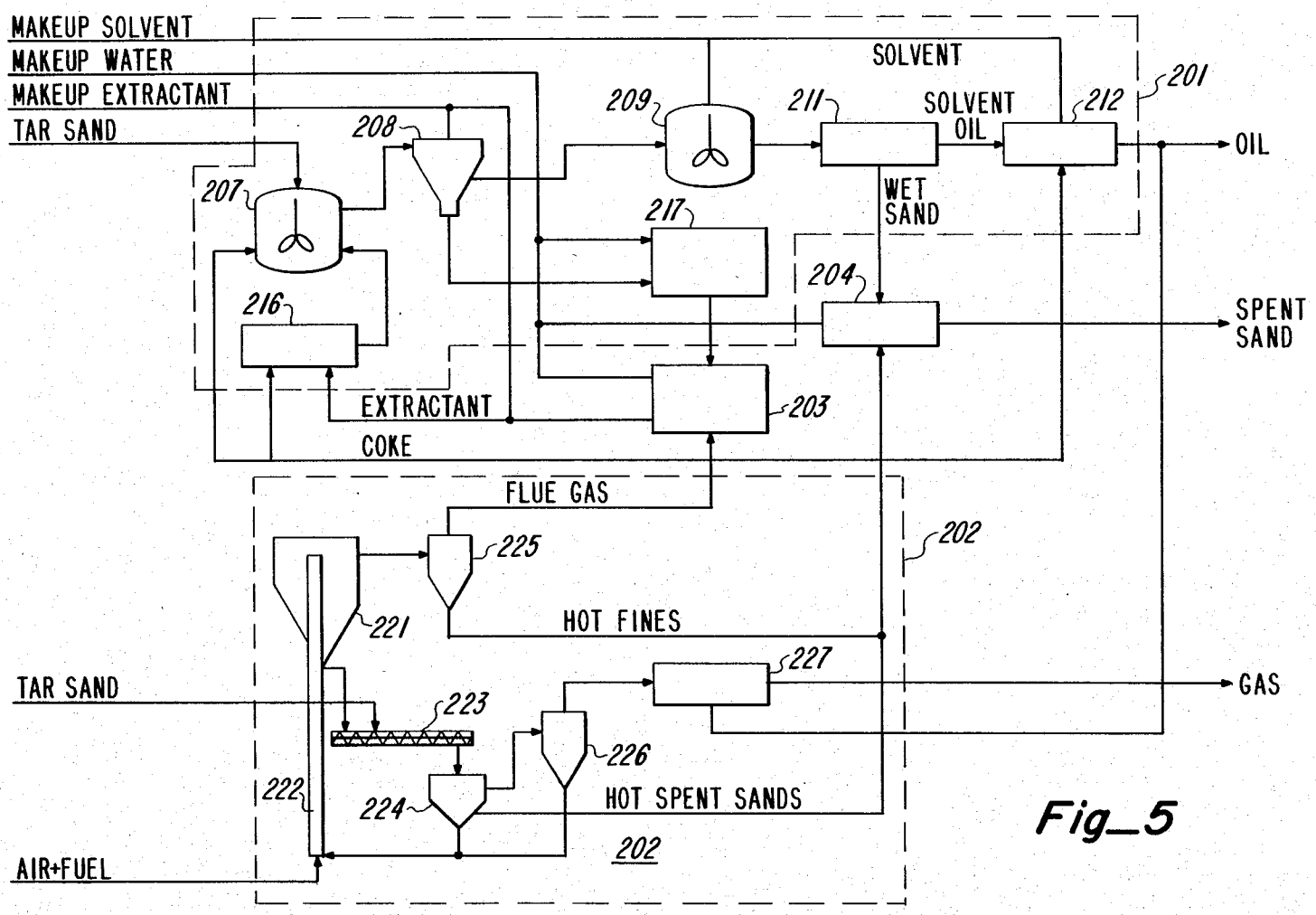
FIG. 5 is a schematic diagram showing another example of a combination of solvent extraction and thermal operations according to the present invention.

For example, as shown in FIG. 5 a CAG solvent extraction operation 201 is combined with a Lurgi-Rhurgas thermal operation 202. A water and extractant recovery storage operation 203 and a water and heat recovery operation 204 are utilized as recovery operations between operations 201 and 202. Briefly, the CAG operation includes a boiler-mixer 207 into which the crushed tar sand is initially delivered. From the mixer 203 the tar sand is successively passed into a cyclone separator 208, mixer 209, centrifuge 211 and processor 212. The oil product from the solvent extraction operation 201 is taken from the processor 205 as shown. A significant feature of the CAG process is the use of an inorganic extractant shown as supplied by a water and extracting stage 205 and a make-up extractant line. The extractant is delivered into a preheater 216 and then into the boiler-mixer 207. This extractant has the effect of reducing the physical affinity between the tar and sand and allows the tar to float to the surface leaving most of the sand in the bottom. The sand would be removed from the extractant bitumen principally by centrifuge 211. Water from a make-up water line and the under flow of the cyclone separator 208 is delivered to a wash tank 217 which in turn delivers the water to stage 203. Spent sand is taken from recovery stage 204.

Briefly, the Lurgi-Rhurgas retort operation includes a gas-solids separator bin 221 with a depending lift pipe 222. Tar sand is delivered to the bin 221 and the bin feeds a mixing screw-type retort 223. The output from retort 223 is delivered to a solids surge bin 224 from which hot spent sands are taken and used by recovery stage 204 above described. A part of the hot spent sands are returned to the bottom of the lift pipe and air and fuel, if required, are also supplied thereto. A dust removal cyclone 225 receives gas from the top of bin 221 and provides flue gas to the water and extractant recovery stage 203 above-described and hot fines pass to recovery stage 204. A dust removal cyclone 226 receives oil product from the bin 224 and the overflow is passed to a condenser 227 from which the oil product from the thermal operation is taken and combined with that of the solvent extraction operation 201 as indicated. The details of the Lurgi-Rhurgas process are found in

| Refer To Numerals In FIG. 4 | 13 | 203 | 204 | 42 | 211 | 227 | 216 | 218 | 221 | 48 | 224 | 231 | 234 | 235 | 22 | 250 | 54 | 49 |
|---|---|---|---|---|---|---|---|---|---|---|---|---|---|---|---|---|---|---|
| Solvent/ Sand, lb/hr | 6,000 | 12,602 | 12,602 | 3,891 | 8,711 | 6,444 | 15,155 | 6,602 | 8,553 | 5,856 | 14,409 | 7,965 | 7,965 | 2,330 | 6,010 | 2,330 | 5,786 | 70 |
| Sand, lb/hr | 5,520 | 5,520 | 5,520 | 0 | 5,520 | 0 | 5,520 | 0 | 5,520 | 0 | 5,520 | 5,520 | 5,520 | 0 | 5,520 | 0 | 0 | 0 |
| Solid Tar lb/hr | 480 | 400 | 346 | 0 | 173 | 0 | 69 | 0 | 69 | 0 | 45 | 45 | 45 | 0 | 45 | 0 | 0 | 0 |
| Liquid Tar, lb/hr | 0 | 537 | 591 | 430 | 334 | 62 | 500 | 457 | 43 | 9 | 76 | 14 | 14 | 0 | 14 | 0 | 9 | 0 |
| Solvent lb/hr | 0 | 6,145 | 6,145 | 3,461 | 2,684 | 6,382 | 9,066 | 6,145 | 2,921 | 5,487 | 8,768 | 2,386 | 2,386 | 2,330 | 56/375 $H_2O$ | 2,330 | 5,777 | 70 |
| Temp., °F. | Amb. | 120 | 120 | 120 | 120 | 120 | 120 | 120 | 120 | 120 | 120 | 120 | 120 | 157 | 100 | 120 | 120 | 120 |
| Pressure Psia. | | 12.0 | 12.0 | 12.0 | 12.0 | 12.0 | 12.0 | 12.0 | 12.0 | 12.0 | 12.0 | 12.0 | 12.0 | 12.0 | 12.0 | 12.0 | 12.0 | 12.0 |

the *Synthetic Fuels Data Handbook* Cameron Engineers p. 84, 1975.

Figure 6:
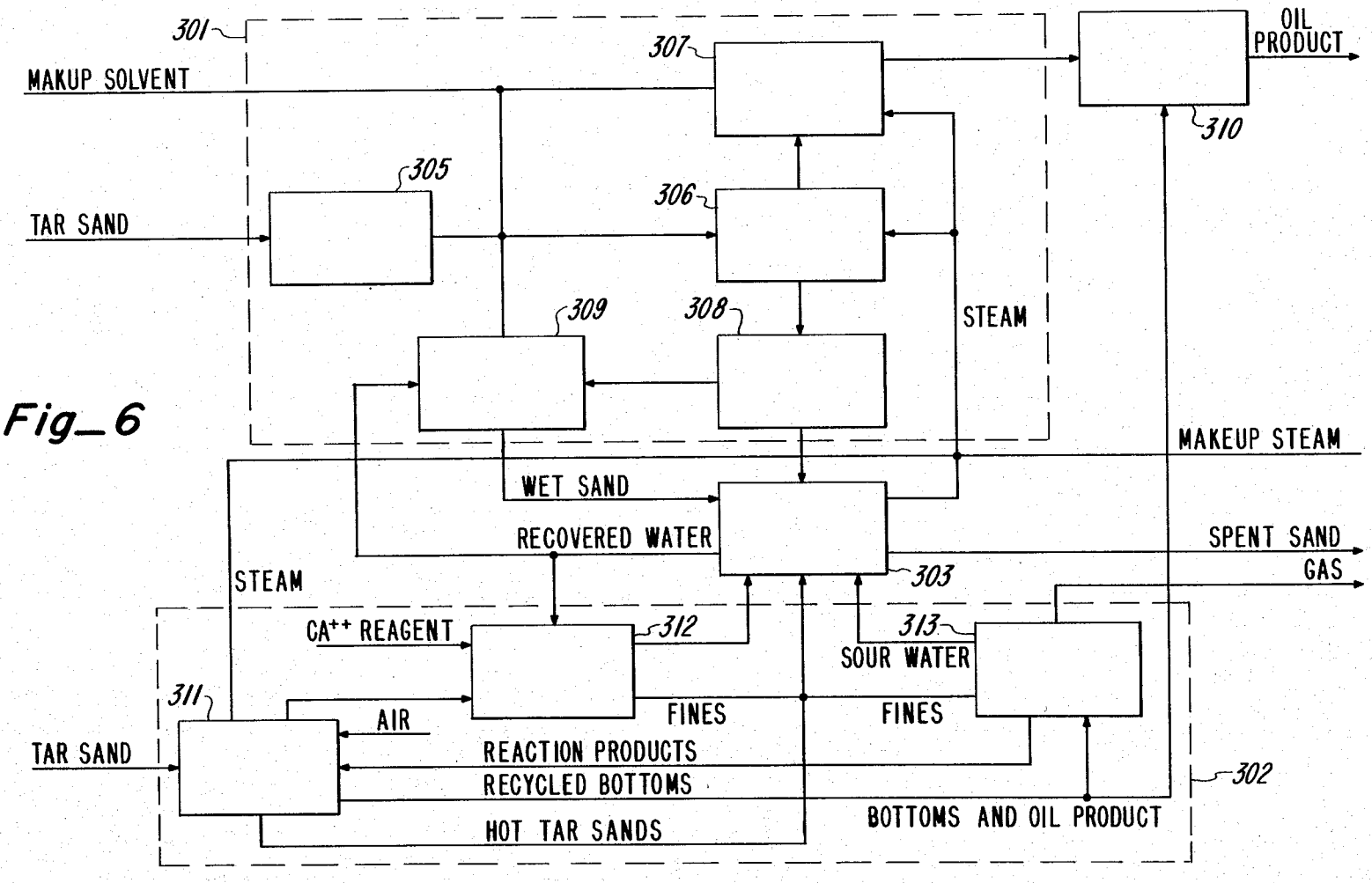
FIG. 6 is a schematic diagram showing yet another example of a combination of solvent extraction and the thermal operations according to the present invention.

Another example of a combination of thermal and solvent extraction-operations is shown in FIG. 6. Briefly described, this combination has a Randall solvent extraction operation 301 and a Taciuk thermal operation 302 having coupled therebetween a water and heat recovery operation 303. The Taciuk thermal process is described in U.S. Pat. No. 4,180,455.

The solvent extraction operation 301 includes a tar sand conditioning stage 305 that receives a feed of crushed tar sand and mixes water therewith. The output of stage 305 is passed to an extract removal stage 306 which effects a hot water beneficiation to get the material that contains the bitumen to separate out. The mixture is then passed to a solvent recovery stage 307 from which the oil product is taken. The sand is taken from the removal stage 306 by a sand removal stage 308. Water is passed from stage 308 to the water to heat recovery stage and to a water clarification stage 309.

The thermal operation 302 shown includes a rotary kiln retort 311 operatively associated with a flue gas treatment stage 312 that feeds the recovery stage 303 and an oil product treatment stage 313. Heat in the form of steam is supplied from the retort to the extract removal stage 306. Against spent sand and recovered water utilized in the treatment is taken from recovery stage 303. The oil product from the retort 311 and solvent recovery stage 307 are combined by a blending stage 310 to provide the final upgraded crude product having a viscosity suitable for transport.

In summary, the combination thermal and solvent extraction operation above-described has the advantages of increased energy efficiency because of the transfer of waste heat from the retort operation to the solvent extraction operation, the oil product is upgraded by a blending of the products from the two operations, make-up solvent is provided from the oil product from the thermal operation which is more compatible with the bitumen to be extracted and the sand from both operations when blended helps minimize the environmental impact. The combination of operations is more suitable for being constructed in small modules compatible with sand deposits in the United States than are the individual operations used separately.

Although the present invention has been described with a certain degree of particularity, it is understood that the present disclosure has been made by way of example and that changes in details of structure may be made without departing from the spirit thereof.

We claim:

1. A process for the production of upgraded oil and sand products during the separation of bitumen from tar sands and the like comprising the steps of:

subjecting a quantity of tar sand to a solvent extraction operation to yield a high viscosity oil product and a substantially bitumen-free sand product;

simultaneously subjecting an additional quantity of tar sand that has not been subjected to said solvent extraction operation to heat in a thermal operation that is operating in parallel with said solvent extraction operation in relation to incoming tar sand to said operations to yield a hot, low viscosity oil product and a hot and dry spent sand product;

recovering heat from said hot and dry spent sand and transferring the recovered heat to the solvent extraction operation to provide a substantial part of the heat requirement for the solvent extraction operation;

combining the low viscosity oil product with the high viscosity oil product to provide an upgraded synthetic crude product and combining the cooled spent sand with said substantially bitumen free sand to provide an environmentally suitable waste sand product; and removing solvent fractions from the high viscosity oil product and from the sand products of said solvent extraction operation and recycling said removed solvent fractions to said solvent extraction operation.

2. A process according to claim 1 wherein said solvent fractions are removed prior to the combining operations.

3. A process according to claim 1 including the flash recovery of solvent from the oil product and solvent mixture.

4. A process according to claim 1 wherein a part of said low viscosity oil product is distilled and passed to sand solvent exchange operation to provide make-up solvent.

5. A process according to claim 1 wherein said high viscosity oil product has a gravity of about 10° to 15° API.

6. A process according to claim 1 wherein said low viscosity oil product has a gravity of about 15° to 20° API.

7. A process according to claim 1 wherein said upgraded synthetic crude product has a gravity of about 15° API.

8. A process according to claim 1 wherein the bitumen in the tar sand is removed in the solvent extraction operation by submerging the tar sand in the solvent and sonicating the solvent with sonic energy to break apart bonds so that the bitumens can go into solution.

9. A process according to claim 1 wherein the heating is carried out in a pair of alternately operable retort vessels with one burning tar sand while the other is being filled with tar sand.

10. A process according to claim 1 wherein said solvent extraction operation includes an inorganic water-based extractant to reduce the affinity between the tar and sand and allows the tar to float to the surface leaving most of the sand in the bottom.

11. A process according to claim 1 wherein said thermal operation includes a mixing screw-type retort and wherein hot sand is recycled back to said retort.

12. A process according to claim 1 wherein said solvent extraction operation includes a hot water beneficiation to get the material that contains the bitumen to spearate and more bitumen from the tar sand.

13. A process according to claim 1 wherein said thermal operation includes a rotary kiln to apply heat to a feed of tar sand.

14. A process for the production of upgraded oil and sand products during the separation of bitumen from tar sands and the like comprising the steps:

subjecting a quantity of tar sand to a solvent extraction operation to yield a high viscosity oil product and a substantially bitumen-free sand product, said solvent extraction operation including removing solvent fractions from said high viscosity oil product, removing solvent fractions from said substantially bitumen-free sand products;

simultaneously subjecting an additional quantity of tar sand to heat to yield a hot, low viscosity oil product and a hot and dry spent sand product;

recovering heat from said hot and dry spent sand and transferring said recovered heat to the solvent extraction operation;

blending said high viscosity oil product with the low viscosity oil product to provide an upgraded synthetic crude product;

blending a cooled spent sand with said substantially bitumen-free sand to provide an environmentally suitable waste sand product; and subjecting said low viscosity oil product to distillation and recycling said distilled oil product for use as a solvent in the solvent extraction operation.

* * * * *